US010843024B2

(12) United States Patent
Astolfi et al.

(10) Patent No.: US 10,843,024 B2
(45) Date of Patent: Nov. 24, 2020

(54) EXERCISE EQUIPMENT

(71) Applicant: Muoverti Limited, London (GB)

(72) Inventors: Alessandro Astolfi, London (GB); Alex Caccia, London (GB); Paul Mitcheson, London (GB)

(73) Assignee: Muoverti Limited, London (GB)

( * ) Notice: Subject to any disclaimer, the term of this patent is extended or adjusted under 35 U.S.C. 154(b) by 124 days.

(21) Appl. No.: 15/568,743

(22) PCT Filed: Apr. 22, 2016

(86) PCT No.: PCT/GB2016/051132
§ 371 (c)(1),
(2) Date: Oct. 23, 2017

(87) PCT Pub. No.: WO2016/170361
PCT Pub. Date: Oct. 27, 2016

(65) Prior Publication Data

US 2018/0085615 A1 Mar. 29, 2018

(30) Foreign Application Priority Data

Apr. 23, 2015 (GB) ..... 1506937.0

(51) Int. Cl.
*A63B 21/005* (2006.01)
*A63B 22/00* (2006.01)
(Continued)

(52) U.S. Cl.
CPC .... *A63B 21/0058* (2013.01); *A63B 21/00181* (2013.01); *A63B 22/0076* (2013.01);
(Continued)

(58) Field of Classification Search
CPC ..... A63B 21/00181; A63B 21/0058; A63B 21/225; A63B 22/0076; A63B 22/025;
(Continued)

(56) References Cited

U.S. PATENT DOCUMENTS 4,938,475 A * 7/1990 Sargeant ..... A63B 21/0053 482/9
4,976,424 A * 12/1990 Sargeant ..... A63B 21/0053 482/3
(Continued)

FOREIGN PATENT DOCUMENTS

CN 102343139 A 2/2012
GB 2412606 A 10/2005
(Continued)

OTHER PUBLICATIONS

International Search Report for PCT/GB2016/051132 completed Jun. 20, 2016 (3 pages).
Search Report under Section 17 for GB1506937.0 (2 Pages).

*Primary Examiner* — Joshua Lee
(74) *Attorney, Agent, or Firm* — Brian B. Shaw, Esq.; Harter Secrest & Emery, LLP

(57) ABSTRACT

A system for synthesising inertia in exercise equipment, the exercise equipment comprising a rotatable member to which a user applies a user torque in use, the system comprising: an electric drive system comprising an electric motor operably connected to the rotatable member, the electric motor configured to impart a resistance torque, in use, on the rotatable member of the exercise equipment, whereby the resistance torque opposes the user torque; at least one sensor for monitoring a user input to the rotatable member; and a control system, comprising at least a processor and a memory, wherein the control system is connected to the at least one sensor and is configured to use the input from the at least one sensor and at least one predetermined parameter storable in the memory, to determine a resistance torque and to provide instructions to the electric drive mechanism to impart said resistance torque on said rotatable member.

18 Claims, 2 Drawing Sheets

Figure 1:
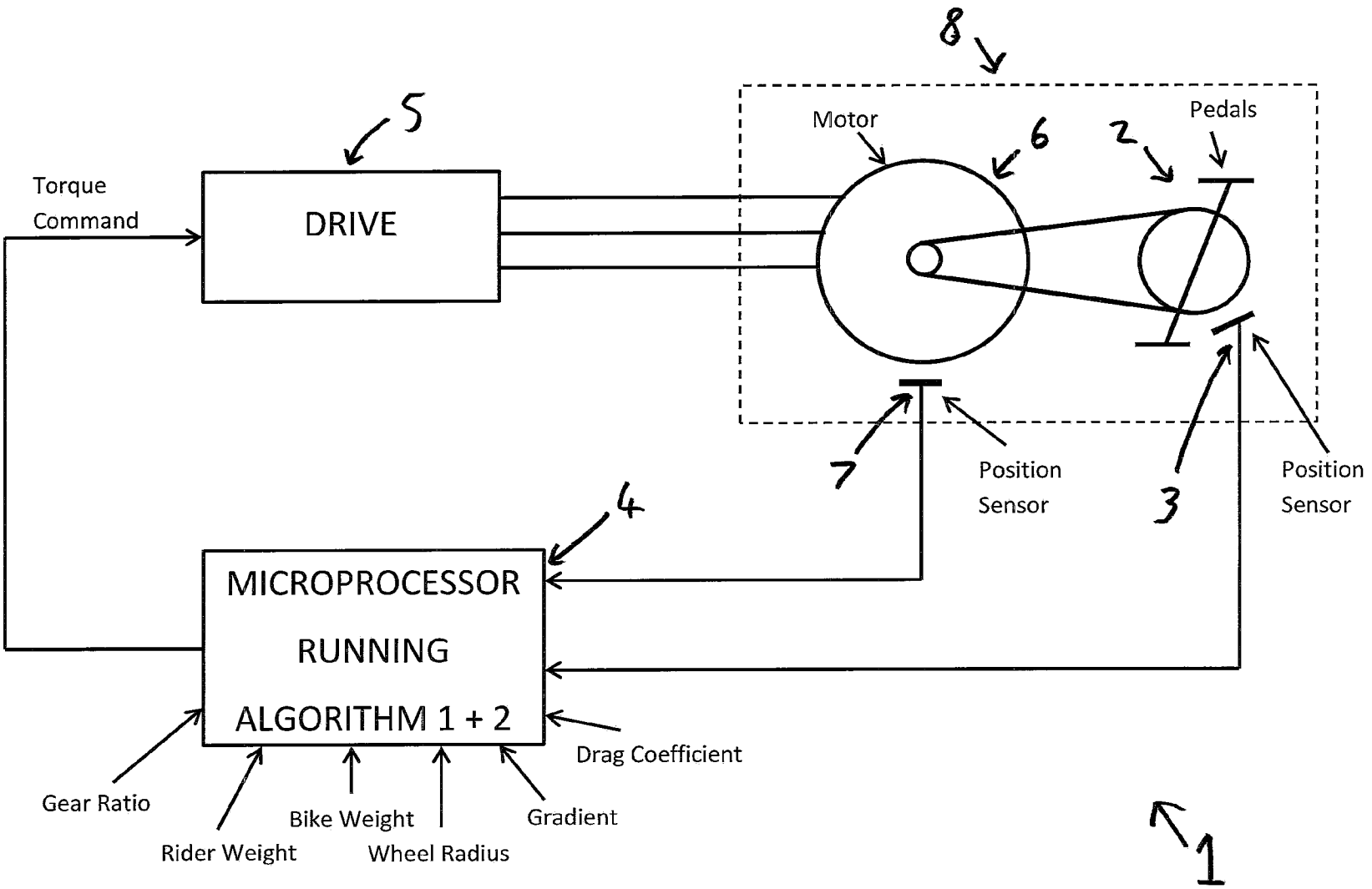

(51) Int. Cl.

| | |
|---|---|
| ***A63B 24/00*** | (2006.01) |
| ***A63B 22/06*** | (2006.01) |
| ***A63B 21/00*** | (2006.01) |
| ***A63B 71/06*** | (2006.01) |
| *A63B 21/22* | (2006.01) |
| *A63B 22/02* | (2006.01) |
| *A63B 22/04* | (2006.01) |

(52) U.S. Cl.

CPC ..... *A63B 22/0605* (2013.01); *A63B 24/0062* (2013.01); *A63B 24/0087* (2013.01); *A63B 71/0622* (2013.01); *A63B 21/225* (2013.01); *A63B 22/025* (2015.10); *A63B 22/04* (2013.01); *A63B 2024/009* (2013.01); *A63B 2024/0093* (2013.01); *A63B 2071/0638* (2013.01); *A63B 2220/16* (2013.01); *A63B 2220/34* (2013.01); *A63B 2220/54* (2013.01); *A63B 2220/76* (2013.01); *A63B 2220/78* (2013.01); *A63B 2225/20* (2013.01); *A63B 2225/50* (2013.01); *A63B 2230/062* (2013.01)

(58) Field of Classification Search

CPC . A63B 22/04; A63B 22/0605; A63B 24/0062; A63B 24/0087; A63B 71/0622; A63B 2024/009; A63B 2024/0093; A63B 2071/0638; A63B 2220/16; A63B 2220/34; A63B 2220/54; A63B 2220/76; A63B 2220/78; A63B 2225/20; A63B 2225/50; A63B 2230/062

See application file for complete search history.

(56) References Cited

U.S. PATENT DOCUMENTS

| | | | | |
|---|---|---|---|---|
| 5,240,417 | A * | 8/1993 | Smithson | A63B 21/00181 434/61 |
| 5,256,115 | A * | 10/1993 | Scholder | A63B 21/0053 482/4 |
| 5,364,271 | A | 11/1994 | Aknin et al. | |
| 5,919,115 | A | 7/1999 | Horowitz et al. | |
| 7,833,135 | B2 * | 11/2010 | Radow | A63B 22/0605 482/4 |
| 7,862,476 | B2 * | 1/2011 | Blau | A63B 21/0051 482/5 |
| 9,468,794 | B2 * | 10/2016 | Barton | A63B 71/0622 |
| 2006/0003872 | A1 | 1/2006 | Chiles et al. | |
| 2007/0149364 | A1 | 6/2007 | Blau et al. | |
| 2008/0207402 | A1 | 8/2008 | Fisher et al. | |
| 2009/0011907 | A1 | 1/2009 | Radow et al. | |
| 2009/0118099 | A1 * | 5/2009 | Fisher | A63B 21/0052 482/5 |
| 2010/0113223 | A1 | 5/2010 | Chiles et al. | |
| 2011/0118086 | A1 | 5/2011 | Radow et al. | |
| 2013/0059698 | A1 * | 3/2013 | Barton | A63B 71/0622 482/63 |
| 2014/0194250 | A1 | 7/2014 | Reich et al. | |

FOREIGN PATENT DOCUMENTS

| | | | |
|---|---|---|---|
| TW | 200819168 | A | 5/2008 |
| WO | 92/16267 | | 10/1992 |
| WO | 2008/002644 | A2 | 1/2008 |
| WO | 2009/003170 | A1 | 12/2008 |
| WO | 2012/160523 | A2 | 11/2012 |

* cited by examiner

EXERCISE EQUIPMENT

DESCRIPTION OF THE INVENTION

This invention relates to a system for synthesising inertia, in particular for use with a system which simulates a physical activity, such as exercise equipment.

In order to improve fitness, many people use exercise machines. A user may use one of a myriad of exercise machines available such as a stationary bike, a rowing machine, a SkiErg, a running machine, a cross trainer or a step machine. A user may use different exercise machines in order to exercise different muscle groups or as a training aid for a specific sport. When using an exercise machine, a user may simply use an exercise machine with a fixed resistance. Exercise machines with a variable resistance have an advantage over fixed resistance exercise machines because they allow a user to increase or decrease the difficulty of their exercise as required. Typically, exercise machines have a variable resistance.

However, it is recognised in the art that when simulating some physical activities, exercising against a fixed or a variable resistance does not provide a realistic training experience. It is advantageous for a user to train on an exercise machine that utilises more than resistance when simulating a physical activity. This advantage arises because when a user wants to simulate environmental features such as a hill, headwind, tailwind or different terrain, a variable resistance exercise machine attempting to simulate such a feature absorbs energy at a faster rate than a user performing the corresponding physical activity.

Exercise machines that simulate environmental features exist in the art. However, these machines do not provide a realistic simulation for many environmental features.

WO 2009/003170 discloses an exercise bike that comprises a flywheel having an adjustable moment of inertia, the flywheel operably coupled to a controller such that a rider's mass can be input and the inertia of the flywheel can be adjusted to take the rider's mass into account. The flywheel is used in combination with an alternator or a friction brake.

US 2006/003872 discloses an exercise bike that comprises a flywheel and a motor. The motor is able to assist the rotation of the flywheel.

It is desirable to have an exercise bike that takes into account a user's physical characteristics and is able to realistically replicate a range of environmental features.

The present invention aims to address at least some of these problems.

The present invention relates to a system for synthesising inertia in exercise equipment, the exercise equipment comprising a rotatable member to which a user applies a user torque in use, the system comprising: an electric drive system comprising an electric motor operably connected to the rotatable member, the electric motor configured to impart a resistance torque, in use, on the rotatable member of the exercise equipment, whereby the resistance torque opposes the user torque; at least one sensor for monitoring a user input to the rotatable member; and a control system, comprising at least a processor and a memory, wherein the control system is connected to the at least one sensor and is configured to use the input from the at least one sensor and at least one predetermined parameter storable in the memory, to determine a resistance torque and to provide instructions to the electric drive mechanism to impart said resistance torque on said rotatable member.

Preferably, the system further comprises a motor sensor, wherein the motor sensor is connected to the control system and the control system is configured to use the input from the motor sensor and store a motor speed value in the memory.

Preferably, the rotatable member is operably connected to the electric motor by a gearing system.

Preferably, the rotatable member is rotatable about a first axis and the electric motor has a shaft rotatable about a second axis, at least one gear on at least one of the first and second axes and at least one gearing sensor to monitor the gear selection on at least one of the first and second axes and wherein the at least one gearing sensor is connected to the control system and the control system is configured to use the input from the at least one gearing sensor to calculate a gear ratio value and store the gear ratio value in the memory.

Preferably, the control system is configured to estimate the user torque applied to the rotatable member using at least the motor speed value and values of a motor constant of the electric motor and an inertia of the electric motor which are stored in the memory.

Preferably, the control system is configured to use the gear ratio value when estimating the user torque applied to the system.

Preferably, the system further comprises a user interface configured to receive a user mass value, wherein the user interface is connected to the control system and is configured to store the user mass value in the memory.

Preferably, the control system is configured to store values corresponding to physical exercise equipment in the memory, the values comprising at least a mass of physical exercise equipment to be simulated, a mass of a physical wheel to be emulated, a radius of the physical wheel to be emulated and an inertia of a physical wheel member to be emulated.

Preferably, the control system is configured to generate a model of the physical exercise equipment by applying the values corresponding to the physical exercise equipment.

Preferably, the control system is configured to emulate the inertia of the physical exercise equipment, using the model of the physical exercise equipment.

Preferably, the control system is configured to use the estimate of the user torque, the gear ratio value and the emulated inertia to provide instructions to the electric drive system to adjust a current supplied to the electric motor, such that the electric motor imparts a resistance torque to the rotatable member, the resistance torque related to the emulated inertia.

Preferably, the control system is configured to provide instructions to the electric drive system based on the difference between a desired speed that is output by the model of the physical exercise equipment and the motor speed value stored in the memory.

Preferably, the control system is configured to simulate at least one environmental feature, by adjusting the emulated inertia.

Preferably, the environmental feature to be simulated is freewheeling at a first speed, the control system further retrieving both a value from the memory for a threshold speed and a value from the memory for a first friction gain at a first motor speed lower than the threshold speed, the retrieved values for use in calculating the desired speed.

Preferably, the environmental feature to be simulated is freewheeling at a second speed, the control system further retrieving both a value from the memory for the threshold speed and a value from the memory for a second friction gain at a second motor speed higher than the threshold speed, the retrieved values for use in calculating the desired speed.

Preferably, the environmental feature to be simulated is a slope, the control system further retrieving values for gravity, Pi, and the angle of the slope to be simulated from the memory to use in calculating the desired speed.

Preferably, the environmental feature to be simulated is an aerodynamic effect, the control system further retrieving values for the density of the air, a cross sectional area of a rider, speed of the wind and a threshold to determine when aerodynamic correction is needed from the memory to use in calculating the desired speed.

Preferably, the environmental feature to be simulated is rolling friction, the control system further retrieving values for rolling resistance, and gravity from the memory to use in calculating the desired speed.

Preferably, any combination of environmental features may be simulated when the user is using the exercise equipment.

Preferably, the user interface is configured to allow a user to select the environmental features or a programme of environmental features to be simulated.

Preferably, the rotatable member and the electric motor are connected by a belt.

Preferably, the rotatable member and the electric motor are connected by a chain.

Preferably, the control system is connected to an external device and the control system is configured to communicate with the external device.

Preferably, the system further comprises a pedal position sensor, wherein the pedal position sensor is connected to the control system and the control system is configured to use the input from the pedal position sensor.

Preferably, the system further comprises a pedal position sensor, wherein the pedal position sensor is connected to an external device, and the external device is configured to use the input from the pedal position sensor.

Preferably, the system is configured to use the input from the pedal position sensor to draw a polar view graph of user torque versus pedal position.

Preferably, any novel matter or combination thereof herein described.

Preferably, a system for synthesizing inertia substantially as herein described with reference to the figures.

Figure 2:
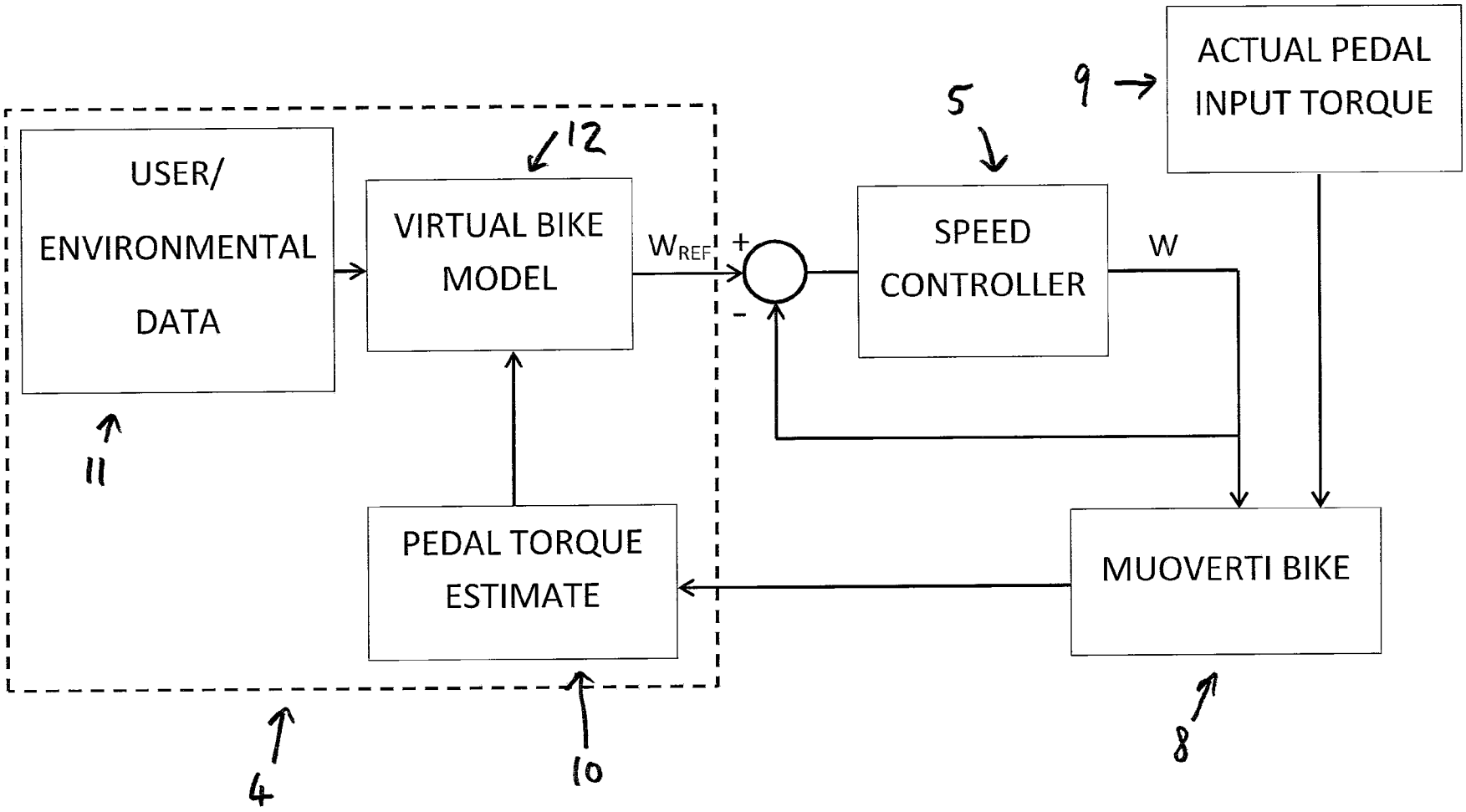

In order that the present invention may be more readily understood, embodiments thereof will now be described, by way of example, with reference to the accompanying drawings, in which:

FIG. 1 is a schematic view of a system for synthesising inertia in exercise equipment according to the present invention; and FIG. 2 is a schematic view of the electronics of a system for synthesising inertia in exercise equipment according to the present invention.

The embodiment shown in FIG. 1 comprises an exercise bike 8 (only part of which is shown). The exercise bike 8 further comprises pedals 2, which a user applies a user torque in use, a pedal position sensor 3, an electric motor 6 and a motor sensor 7. The pedals 2 are connected to an input shaft or a rotatable member by cranks. In some embodiments, the drive shaft of the electric motor 6 is operably connected to the input shaft by a belt. In other embodiments, a chain or other connection means are used to connect the drive shaft of the electric motor 6 to the input shaft.

The belt allows the drive shaft of the electric motor 6 to impart a variable resistance torque, in use, to the input shaft, requiring a variable input user torque to move the pedals 2.

The electric motor 6 is connected to the electric drive system 5. The electric drive system 5 receives instructions from the control system 4 and alters the current applied to the electric motor 6. In this way, a user is able to exercise against a fixed or variable resistance. By applying a current to the electric motor 6, the system is able to change user input torque required by the user.

The control system 4 is connected to at least the motor sensor 7 and is configured to use the input from the motor sensor 7 and at least one predetermined parameter storable in the memory, to determine a resistance torque and to provide instructions to the electric drive mechanism to impart the resistance torque on the rotatable member. The control system 4 is configured to use the input from the motor sensor 7 to store a motor speed value in the memory. The motor sensor 7 may be connected to the control system 4 by wired or wireless means.

In some embodiments, the pedal position sensor 3 is connected to the control system 4 and the control system 4 is configured to use the input from the pedal position sensor. In other embodiments, the pedal position sensor 3 is connected to an external device such as a tablet, phone or smart watch. In both of these embodiments, the control system 4 or external device is configured to use the input from the pedal position sensor to draw a polar view graph of user torque versus pedal position and display it to the user. The user is able to use the polar view graph in order to improve their pedalling technique.

An advantage of the present invention is that it is able to emulate the inertia experienced by a user when cycling on a physical bicycle. The control system 4 models a virtual bike based on fixed and variable inputs, which are used to emulate cycling in the real world. Based on the virtual bike model, the control system 4 varies the instructions to the electric drive system 5. These instructions cause the electric drive system 5 to vary the current applied to the electric motor 6. By applying a variable current to the electric motor 6, the torque input required by the user can be altered in a way that emulates the inertia of a physical bike. For example, it is more difficult to accelerate a heavy bike from rest due to inertia, however a heavy bike will continue further up an incline before stopping than a light bike due to inertia. One of the aims of the present invention is to emulate this behaviour.

In some embodiments, the input shaft or rotatable member is operably connected to the electric motor by a gearing system. In some embodiments, the user is able to select a first gear on a first axis and in other embodiments, the user is also able to select a second gear on a second axis. A gearing sensor monitors the gear selection and provides an input to the control system 4, such that the control system 4 receives information about the gear selection as an input. The control system 4 may receive information about the gear selection by wired or wireless means. In embodiments where the gear ratio between the first and second axis is fixed, the control system 4 may have the gear ratio stored in a memory.

In some embodiments, the control system 4 is configured to estimate the user torque applied to the input shaft or rotatable member using at least the motor speed value and values of a motor constant of the electric motor and an inertia of the electric motor which are stored in the memory.

The gear ratio is used by the control system to aid in calculating the user torque imparted by the user and the reference speed.

In use, a user sits on the bike 8. In some embodiments, the user inputs their mass into a user interface, the user interface configured to receive a user mass value. The user interface is connected to the control system 4, such that information is transferred from the user interface to the control system 4 and the control system 4 is configured to store the user mass value in the memory. In other embodiments, the control system 4 assumes a user mass. In further embodiments, the system weighs the user as they sit on the bike.

The control system 4 provides instructions to the electric drive system 5 based on a number of inputs. These inputs are both fixed inputs stored in a memory of the control system 4 and variable inputs received from sensors or a user interface. The inputs include the speed of the electric motor 6, the gear ratio, the mass of the user, the mass of the bike or physical exercise equipment to be emulated, the radius of the physical wheel to be emulated, the inertia of the physical wheel member to be emulated, the gradient of a slope to be emulated and the resistance of the surface to be emulated and calculates the torque to be imparted by the electric motor 6. Other inputs to the control system 4 are also contemplated.

The control system 4 is configured to emulate the inertia of physical exercise equipment, using a virtual model of the physical exercise equipment. The control system 4 uses the fixed and variable inputs as part of a virtual bike model. An output of the virtual bike model is a reference speed. The reference speed is the required speed of the electric motor 6 required to impart a resistance torque to the user that simulates the resistance and inertia experienced by a user using a physical bicycle. The reference speed is used to instruct the electric drive system 5 to change the speed of the electric motor 6. By changing the speed of the electric motor 6, the system is able to change the torque imparted to the user.

The control system 4 is configured to use the estimate of the user torque, the gear ratio value and the emulated inertia to provide instructions to the electric drive system 5 to adjust a current applied to the electric motor 6, such that the electric motor 6 imparts a resistance torque to the input shaft or rotatable member, the resistance torque related to the inertia calculated by the virtual bike model.

If the speed of the electric motor 6 is faster than the calculated reference speed, the control system instructs the electric drive system 5 to modify the current applied to the electric motor 6, thereby increasing the resistance torque imparted to the user. If the speed of the electric motor 6 is slower than the calculated reference speed, the control system instructs the electric drive system to modify the current applied to the electric motor 6, thereby decreasing the resistance torque imparted to the user.

In some embodiments of the present invention, increasing the current applied to the electric motor 6 may increase the resistance torque imparted to the user and decreasing the current applied to the electric motor 6 may decrease the resistance torque imparted to the user. The maximum resistance torque imparted to the user may be when a maximum current is applied to the electric motor 6. The minimum resistance torque imparted to the user may be when zero current or a minimum current applied to the electric motor 6.

Such an embodiment may comprise a user rotating the rotatable member or input shaft in the opposite direction to the direction that the electric motor rotates. When an increased current is applied to the electric motor 6, the user needs to apply a larger user torque to overcome the resistance torque.

In other embodiments of the present invention, decreasing the current applied to the electric motor 6 may increase the resistance torque imparted to the user and increasing the current applied to the electric motor 6 may decrease the resistance torque imparted to the user. The maximum resistance torque imparted to the user may be when zero current or a minimum current is applied to the electric motor 6. The minimum resistance torque imparted to the user may be when a maximum current is applied to the electric motor 6.

Such an embodiment may comprise a user rotating the rotatable member or input shaft in the same direction as the direction that the electric motor rotates. When no current is applied to the electric motor 6, the user needs to apply a larger user torque to overcome the resistance of the electric motor. The electric motor may act like an alternator. When a current is applied to the electric motor, the resistance of the electric motor decreases and hence the resistance torque imparted to the user decreases as well.

The control system 4 uses the mass of the user and a stored value of the mass of a physical bike to calculate the inertia to be emulated. For example, a heavier user gives a larger combined inertia of the user and the bike than a lighter user. In some embodiments of the present invention, the control system 4 will instruct the drive system 5 to alter the current applied to the electric motor 6 such that the electric motor 6 imparts a larger resistance torque to a heavier user under some simulated conditions, for example when a user is accelerating up a simulated gradient.

If a wheel with a larger radius is emulated, the output of the bike model will be that of a bicycle that takes longer to accelerate.

The control system 4 is configured to simulate at least one environmental feature, by adjusting the emulated inertia to simulate different environmental features or combinations of environmental features. The examples of environmental features given are not limiting and other environmental features are contemplated.

When the control system 4 is emulating an environmental feature such as an incline, a high-friction surface or a combination of an incline and a high-friction surface, the control system takes into account the inertia of the physical bike being emulated and the inertia of the user along with the gradient of the incline, the friction of the surface or combination of the two. Emulating a steeper incline or a higher friction surface causes the control system 4 to instruct the drive system 5 to alter the current applied to the electric motor 6 such that the torque imparted to the user increases in a manner similar to that of an equivalent physical bike and environmental feature.

In order to calculate how the motor speed and hence the torque imparted to a user should change, the control system 4 has the speed of the electric motor 6 as an input. The control system 4 compares the actual speed of the electric motor 6 to the reference speed. The difference between the speed of the motor and the reference speed is used to instruct the drive system 5 to change the current applied to the electric motor 6.

The user may select a profile using the user interface. The profiles may comprise different environmental features or combinations of environmental features to be emulated by the control system 4. The environmental features to be emulated comprise features such as slopes, flat stretches, aerodynamic effects (such as wind speed or air drag), different terrains, rolling friction or a combination thereof. In some embodiments, when emulating aerodynamic effects, the control system retrieves an aerodynamic threshold from the memory. If the aerodynamic threshold is not reached, aerodynamic effects are not applied. Other environmental features are contemplated. In some embodiments of the present invention, the environmental features also comprise user actions such as freewheeling at low and high speed, the control system 4 configured to retrieve values from a memory for friction gain at low freewheeling speeds, friction gain at high freewheeling speeds and a threshold value. If the motor speed is below the threshold value, friction gain at low speed is applied and if the motor speed is above the threshold value, the friction gain at high speed is applied. Other user actions are contemplated. The user will impart a torque to the pedals 2 and will experience a resistance torque imparted by the electric motor 6, the resistance torque based on the environmental profile selected. In some embodiments, the resistance torque varies with time, for example simulating a slope and a flat stretch. Embodiments of the present invention also provide feedback to the user, such as the environmental feature being simulated. This feedback may also be the profile selected, the speed of the user is pedalling, the user heart rate, the total distance cycled or other parameters known in the art.

In some embodiments of the present invention, the control system 4 has values stored in the memory such as a value for the acceleration due to gravity, Pi, the density of air, the cross-sectional area of a rider or a threshold to determine when aerodynamic correction is needed. The control system 4 is programmed to use this values when calculating the inertia and resistance of different or combinations of environmental features, modelling a virtual bike or performing any other calculations.

The system for synthesising inertia in exercise equipment is auto-calibrated to remove static and dynamic friction from the bearings of the electric motor 6. Some profiles emulating environmental features will result in a scenario where the electric motor 6 imparts zero torque to the pedals 2, and the current supplied to the motor is only enough to overcome the inertia and resistance of the electric motor 6. For example, such a scenario may present itself when the control system 4 is emulating a user going downhill or experiencing a strong tailwind.

The user interface may allow other inputs known to a person skilled in the art, such as heart rate monitoring, user age and the like. The control system 4 may use these additional inputs as a basis to calculate the torque to be imparted by the electric motor 6. As an example, the control system 4 may increase the torque imparted to a user in order to increase a user's heart rate.

FIG. 2 shows a schematic diagram of how the system for synthesising inertia 1 calculates the resistance torque to be imparted by the electric motor 6. A user applies a user input torque 9 to the exercise bike 8. The control system 4 calculates an estimate of the torque the user is applying to the pedals 2, a pedal torque estimate 10. The control system 4 also takes stored values 11 corresponding to the user and environmental data and applies the pedal torque estimate 10 and the values 11 to a virtual bike model 12. The virtual bike model 12 generates a reference speed at which the electric motor 6 should be running at. The control system 4 compares this reference speed to the actual speed of the electric motor 6. The control system 4 uses the difference between the reference speed of the electric motor 6 and the actual speed of the electric motor 6 to instruct the electric drive 5 to alter the current applied to the electric motor 6, thereby changing the resistance torque imparted by the electric motor 6.

When calculating the reference speed, the control system 4 first calculates a linear reference speed and converts it to an angular reference speed, in order to compare the reference speed to the speed of the electric motor 6. The linear reference speed that the control system 4 calculates is calculated using several equations. If the system is not modelling any environmental features, the linear reference speed is computed as follows:

$$\frac{1}{\text{Emulated Inertia}} * \frac{1}{\text{User Gear Ratio}} * \frac{\text{Pedal Torque Estimate}}{\text{Physical Wheel Raius}} * \text{Gain} \qquad \text{Equation 1}$$

In some embodiments of the present invention, the control system 4 emulates one or more of a number of environmental features, each feature contributing to the linear reference speed.

In some embodiments of the present invention, the control system 4 updates the calculated values, such as the linear reference speed, estimate of the user torque and environmental features at a regular interval or frequency. In some embodiments of the present invention this may always be the same frequency, in other embodiments of the present invention this frequency may increase or decrease, for example in response to the processing load on the control system.

In different embodiments of the present invention, the update frequency may be once a second, tens of times a second, hundreds of times a second, thousands of times a second or a mix of different update frequencies.

Each update of the calculated values forms an iteration and each set of equations to be calculated forms the main loop. The update frequency refers to how often the main loop is run.

For embodiments that emulate freewheeling at a low speed, the control system 4 calculates the contribution using the following equation:

$$-\left(\frac{1}{Em.\ \text{Inertia}}\right) * \text{Low Gain} * \text{Last Speed} \qquad \text{Equation 2}$$

Where "Em. Inertia" is the emulated inertia, "Low Gain" is the friction gain at low speed and "Last Speed" is the linear reference speed at the previous iteration.

For embodiments that emulate freewheeling at a high speed, the control system 4 calculates the contribution using the following equation:

$$-\left(\frac{1}{Em.\ \text{Inertia}}\right) * (\text{High Gain} * (\text{Last Speed} - F.\ \text{Threshold}) + \text{Low Gain} * F.\ \text{Threshold}) \qquad \text{Equation 3}$$

Where "High Gain" is the friction gain at high speed and "F. Threshold" is the threshold value to determine whether to apply the low speed friction gain or the high speed friction gain.

For embodiments that emulate a slope, the control system 4 calculates the contribution using the following equation:

$$\left(\frac{1}{Em.\ \text{Inertia}}\right) * (\text{Bike Mass} + \text{User Mass}) * G * \sin\left(\frac{\pi}{180} * \text{Slope}\right) \qquad \text{Equation 4}$$

Where "Bike Mass" is the mass of the physical bike to be emulated, "User Mass" is the actual or assumed mass of the user, "G" is the acceleration due to gravity, and 'Slope' is the angle of the slope being emulated.

For embodiments that emulate aerodynamic effects, the control system 4 calculates the contribution using the following equation:

$$-\left(\frac{1}{Em.\ \text{Inertia}}\right)*\frac{1}{2}*\text{Air Density}*CSA\ \text{of user}*\text{Drag}*(\text{Wind}+\text{Speed}-A.\ \text{Threshold}) \quad \text{Equation 5}$$

Where "Air Density" is a coefficient for the density of air, "CSA of User" is an assumed or measured cross-sectional area of the user, "Drag" is a drag coefficient, "Wind" is the speed of the wind being emulated, "Speed" is the linear reference speed and "A. Threshold" is a threshold value used by the control system 4 to determine whether to apply aerodynamic effects.

For embodiments that emulate rolling friction, the control system 4 calculates the contribution using the following equation:

$$-\left(\frac{1}{Em.\ \text{Inertia}}\right)*\text{Rolling Resistance}*(\text{Bike Mass}+\text{User Mass})*G \quad \text{Equation 6}$$

Where "Rolling Resistance" is the kinetic friction coefficient of the rolling friction being emulated.

Equations representing other environmental features are contemplated as are equations that emulate the same or similar behaviour as described above.

Depending on the embodiment of the present invention, the control system 4 may use one of the Equations 1-6 or may use any combination of the Equations 1-6.

In some embodiments of the present invention, only positive solutions to Equations 1-6 are used, in other embodiments of the present invention, both negative and positive solutions to Equations 1-6 are used. In the case of a negative solution that is not used, the present invention may replace the result with zero or a null value.

The control system 4 converts Equation 1 into an angular desired speed for the motor as follows;

$$\frac{\text{Default Gear Ratio}}{\text{User Gear Ratio}}*\frac{\text{Linear Reference Speed}}{2*\pi*\text{Physical Wheel Radius}} \quad \text{Equation 7}$$

The virtual bike model 12 calculates the inertia to be emulated, which is used by Equation 1. The inertia to be emulated is calculated as follows:

$$\text{Bike Mass}+\text{User Mass}+\frac{\text{Intertia of Physical Wheel}}{(\text{Physical Wheel Radius})^2} \quad \text{Equation 8}$$

The user torque applied to the rotatable member or input shaft is estimated using the following equations:

A function beta for the adaptive estimation of the torque:

$$\beta=\frac{\text{Gain }\beta}{\gamma}*\text{Main }Rps \quad \text{Equation 9}$$

Where "Gain β" is gain of the function beta, "γ" is the default gear ratio and "Main Rps" is the speed of the electric motor 6 in revolutions per second.

The derivative of the function beta is:

$$B=\frac{\text{Gain }\beta}{\gamma} \quad \text{Equation 10}$$

The following three equations are used by the control system 4 to implement an adaptive estimation algorithm to calculate the estimated torque applied by the user:

$$updateTP=B*M.Const*(\text{Last }C.D.-\text{Spin (main }Rps))+\frac{B}{\gamma}*\max(0,\ oldTP+\beta*M.In) \quad \text{Equation 11}$$

Where "M.Const" is the motor constant as Nm/A, "Last C. D." Is the current given in the previous iteration, "Spin" is the current needed to eliminate the friction of the real motor, "oldTp" is the estimate of the peal torque in the previous iteration and "M. ln" is the inertia of the system, i.e. the electric motor 6 and the belt or chain connecting the electric motor to the rotatable member.

$$TP=oldTP-\frac{1}{\text{Sample Frequency}}*updateTP \quad \text{Equation 12}$$

Where "Sample Frequency" is the frequency of the main loop.

$$TP\ \text{Estimate}=\max(0,TP+\beta*M.\text{ln}) \quad \text{Equation 13}$$

Where "nRear" is the default number of teeth of the rear gear and "nFront" is the default number of teeth of the front gear.

In some embodiments, the user is able to connect an external device such as a tablet, phone, smart watch, heart rate monitor or GPS device to the present invention.

In other embodiments, the present invention receives data from the external device, such the heart rate of the user in real-time or a historic heart rate profile. In these embodiments, the control system 4 of the present invention can use the real-time data and historic heart rate profile in order to change the torque imparted to a user in order to increase or decrease a user's heart rate in line with the historic heart rate profile.

In further embodiments, the user can use a GPS device and other means of collecting data on the environmental features when the user is using a physical equivalent bike. These environmental features can include features such as the gradient, wind speed and terrain. In these embodiments, the control system 4 of the present invention receives data about the environmental features so that it can alter the torque imparted to a user in order to emulate the features experienced by the user on the physical equivalent bike.

In some embodiments, the present invention may access data from an external data source, such as the internet, in order to add environmental features to a pre-recorded route.

In other embodiments, the system displays one of a number of selectable pre-recorded scenes to the user, for example a route through a forest or the countryside. The environmental features of this route, such as the gradient, wind speed and terrain may correspond to the environmental features being emulated by the system, such that, for example, when the system imparts a resistance torque to the user that corresponds to a steep gradient, the user sees a hill on the display.

In further embodiments, the user may record the route using a video recorder or helmet camera when using a physical equivalent bike. This recording is then displayed to the user when the user is using the present invention. Some embodiments of this invention can take pre-recorded GPS data or GPS data that is recorded with the video recorder or helmet camera and combine it such that the present invention simultaneously displays a part of a pre-recorded route and emulates the inertia of that part of the route.

The user experiences a more realistic experience than on a fixed resistance exercise bike. An exercise bike according to the present invention takes the inertia of a physical equivalent bike into account and hence slows down at a slower rate than a fixed resistance bike. This advantage is also present when a slope is being emulated as the modelled inertia causes different behaviour when compared to a fixed resistance bike.

By not including a flywheel, the present system is able to provide faster change in emulated inertia when compared to a system including a flywheel. Furthermore, a smaller current is required to generate a change in inertia as the present system only has to be enough to overcome the inertia of the motor rather than that of a flywheel. The electric motor 6 imparts a resistance torque that emulates the resistance of an environmental feature and the inertia of a bicycle, making use of real-time feedback from the speed of the motor and the torque a user applies to the pedals 2.

Embodiments of the present invention are not limited to a stationary exercise bike. Other embodiments include a rowing machine or a SkiErg, in which a user pulls a member which is attached to the drive shaft of an electric motor 6, an electric drive system 5 and a control system 4, the system imparting a torque to the user that takes into account the inertia of the boat or the skis in a physical equivalent exercise.

Embodiments of the present invention also include a running machine, a cross trainer or a step machine, as they all make use of a rotating shaft to impart a torque to the user. The inertia modelled will be smaller as it only takes into account the inertia of the user, but the same principle applies.

The present invention can be applied to any exercise machine that comprises a rotating shaft which imparts a torque to a user.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or to the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A system for synthesising inertia in exercise equipment, the exercise equipment including a rotatable member to which a user applies a user torque in use, the system comprising:

an electric drive system comprising an electric motor operably connected to the rotatable member, the electric motor configured to impart a resistance torque, in use, on the rotatable member, whereby the resistance torque opposes the user torque;

at least one sensor monitoring a user input to the rotatable member;

a control system, comprising at least a processor and a memory, wherein the control system is connected to the at least one sensor and is configured to use an input from the at least one sensor and at least one predetermined parameter storable in the memory, to determine a resistance torque and to provide instructions to the electric drive system to impart the resistance torque on the rotatable member for synthesising inertia in the exercise equipment;

wherein the rotatable member is independent of a flywheel; and a motor sensor connected to the control system and the control system is configured to use an input from the motor sensor and store a motor speed value in the memory;

wherein the control system is configured to estimate the user torque applied to the rotatable member using at least the motor speed value and values of a motor constant of the electric motor and an inertia of the electric motor which are stored in the memory.

2. The system of claim 1, wherein the rotatable member is operably connected to the electric motor by a gearing system.

3. The system of claim 2, wherein the rotatable member is rotatable about a first axis and the electric motor has a shaft rotatable about a second axis, and further comprising at least one gear on at least one of the first and second axes and at least one gearing sensor to monitor a gear selection on at least one of the first and second axes and wherein the at least one gearing sensor is connected to the control system and the control system is configured to use an input from the at least one gearing sensor to calculate a gear ratio value and store the gear ratio value in the memory.

4. The system of claim 3, wherein the control system is configured to use the gear ratio value when estimating the user torque applied to the system.

5. The system of claim 1, further comprising a user interface configured to receive a user mass value, wherein the user interface is connected to the control system and is configured to store the user mass value in the memory.

6. The system of claim 5, wherein the control system is configured to store values corresponding to physical exercise equipment in the memory, the values comprising at least a mass of physical exercise equipment to be simulated, a mass of a physical wheel to be emulated, a radius of the physical wheel to be emulated and an inertia of a physical wheel member to be emulated.

7. The system of claim 6, wherein the control system is configured to generate a model of the physical exercise equipment by applying the values corresponding to the physical exercise equipment, wherein the control system is configured to emulate the inertia of the physical exercise equipment, using the model of the physical exercise equipment.

8. The system of claim 7, wherein the rotatable member is operably connected to the electric motor by a gearing system;

the rotatable member is rotatable about a first axis and the electric motor has a shaft rotatable about a second axis, at least one gear on at least one of the first and second axes and at least one gearing sensor to monitor the gear selection on at least one of the first and second axes and wherein the at least one gearing sensor is connected to the control system and the control system is configured to use the input from the at least one gearing sensor to calculate a gear ratio value and store the gear ratio value in the memory; and the control system is configured to use the estimate of the user torque, the gear ratio value and the emulated inertia to provide instructions to the electric drive system to adjust a current supplied to the electric motor, such that the electric motor imparts the resistance torque to the rotatable member, the resistance torque related to the emulated inertia.

9. The system of claim 8, wherein the control system is configured to provide instructions to the electric drive system based on a difference between a desired speed that is output by the model of the physical exercise equipment and the motor speed value stored in the memory.

10. The system of claim 7, wherein the control system is configured to simulate at least one environmental feature, by adjusting the emulated inertia.

11. The system of claim 10, wherein the environmental feature to be simulated is at least one of:

freewheeling at a first speed, the control system further retrieving both a value from the memory for a threshold speed and a value from the memory for a first friction gain at a first motor speed lower than the threshold speed, the retrieved values for use in calculating the desired speed;

freewheeling at a second speed, the control system further retrieving both a value from the memory for the threshold speed and a value from the memory for a second friction gain at a second motor speed higher than the threshold speed, the retrieved values for use in calculating the desired speed;

a slope, the control system further retrieving values for gravity, Pi, and the angle of the slope to be simulated from the memory to use in calculating the desired speed;

an aerodynamic effect, the control system further retrieving values for the density of the air, a cross sectional area of a rider, speed of the wind and a threshold to determine when aerodynamic correction is needed from the memory to use in calculating the desired speed; and rolling friction, the control system further retrieving values for rolling resistance, and gravity from the memory to use in calculating the desired speed.

12. The system of claim 10, wherein any combination of environmental features may be simulated when the user is using the exercise equipment.

13. The system of claim 12, wherein the user interface is configured to allow a user to select the environmental features or a program of environmental features to be simulated.

14. The system of claim 1, wherein the rotatable member and the electric motor are connected by a belt or chain.

15. The system of claim 1, wherein the control system is connected to an external device and the control system is configured to communicate with the external device.

16. The system of claim 15, further comprising a pedal position sensor, wherein the pedal position sensor is connected to an external device, and the external device is configured to use the input from the pedal position sensor.

17. The system of claim 1, further comprising a pedal position sensor, wherein the pedal position sensor is connected to the control system and the control system is configured to use the input from the pedal position sensor.

18. The system of claim 17, wherein the system is configured to use the input from the pedal position sensor to draw a polar view graph of user torque versus pedal position.

* * * * *